US005901197A

United States Patent [19]

Khutoryansky et al.

[11] Patent Number: 5,901,197

[45] Date of Patent: May 4, 1999

[54] METHOD OF EXTENDING THE LIFE OF A MULTIPLE FILAMENT X-RAY TUBE

[75] Inventors: Oscar Khutoryansky, Glenview; Thomas Rosevear, Forest Park; Cyril Tomsic, Hanover Park; Emil Rosenzweig, Glenview, all of Ill.

[73] Assignee: Continental X-Ray Corporation, Broadview, Ill.

[21] Appl. No.: 08/915,229

[22] Filed: Aug. 20, 1997

[51] Int. Cl.[6] ..... H01J 35/06

[52] U.S. Cl. ..... 378/15; 378/134; 378/207

[58] Field of Search ..... 378/114, 115, 378/134, 207

[56] References Cited

U.S. PATENT DOCUMENTS

| | | | |
|---|---|---|---|
| 3,649,861 | 3/1972 | Atlee et al. | 313/57 |
| 4,685,118 | 8/1987 | Furbee et al. | 378/114 |
| 4,799,248 | 1/1989 | Furbee et al. | 378/114 |

*Primary Examiner*—Craig E. Church
*Attorney, Agent, or Firm*—Laff, Whitesel, Conte & Saret, Ltd.

[57] ABSTRACT

Methods for extending the life of an X-ray tube having at least two filaments which are individually energizable in which the filaments are successively energized either for a predetermined number of exposures or based on a predetermined passage of time, and methods for predicting imminent failure of still functioning filaments.

25 Claims, 4 Drawing Sheets

METHOD OF EXTENDING THE LIFE OF A MULTIPLE FILAMENT X-RAY TUBE

BACKGROUND

1. Field of the Invention

The present invention relates to X-ray generator control systems. More particularly the present invention relates to methods and apparatus for extending the life of an X-ray tube and for predicting the imminent failure of the X-ray tube by controlling the operation of the filaments in X-ray tubes having cathodes containing at least two filaments.

2. Description of Related Art

X-ray systems typically comprise an X-ray generator, an X-ray tube and a controller. The X-ray generator generates the high power input signals required by the X-ray tube to produce X-rays. The controller generally controls the operation of the X-ray system.

X-ray systems are used in a wide variety of different applications, requiring a variety of different X-ray tube configurations. Generally, the configuration used in a particular application is governed by the amount and intensity of X-rays needed for that application.

In medical applications, the X-ray apparatus must provide sufficient radiation to produce clear images of a patient's internal structures while minimizing the amount of radiation delivered to the patient. For example, radiography requires large doses of high intensity X-ray beams which are emitted toward relatively large subjects. X-radiation output for such radiography has been reduced for some applications through the use of digital radiography systems. On the other hand, fluoroscopy requires much smaller dosages of radiation but over an extended time period.

The X-ray tube is an essential element in medical and other imaging systems. Generally, an X-ray tube is comprised of an anode and a cathode enclosed in an X-ray tube housing having a tube window or port. The function of an X-ray tube is to produce and direct X-rays onto an imaging medium.

X-rays are produced when fast moving electrons contact a target surface. Electrons are formed at the cathode when a cathode filament is heated to high temperatures. The electrons are then accelerated across a large potential difference to collide with the target anode. Upon collision, the electrons interact with atoms of the target to produce X-radiation energy, which is then directed outside the tube onto an imaging medium. The amount of X-radiation emitted from the tube is dependent at least in part on the number of electrons produced and thus the temperature of the filament.

A primary concern in X-ray systems is the maximization of the life span of the X-ray tube. X-ray tubes are a relatively expensive recurring cost in the operation of an X-ray system. The high temperatures which are required cause wear on the entire X-ray tube, most significantly on the filament by vaporization of the filament atoms. Over continued use, the filament is substantially weakened and ultimately fails. Thus, the life of the filament primarily determines the life the X-ray tube.

Another concern in the operation of X-ray systems is preventing unexpected X-ray tube failures. The ultimate failure of an X-ray tube is difficult to predict. Because an X-ray system is inoperable without a functioning X-ray tube, such failure adds significant cost and inconvenience to the normal operation of an X-ray system, such as in a hospital X-ray room. This is especially true for small hospitals and clinics, where backup equipment is not available and for Emergency Rooms and during critical medical procedures, where the life of a patient sometimes depends on the reliability of the equipment.

A number of attempts have been made to reduce the stresses on X-ray tubes, thereby extending their operation. Various materials have been utilized to improve their heat absorption ability. For instance, the anode may be constructed of copper material in order to maximize the transfer of heat away from the electron target. In addition, the anode can be made to rotate, thus extending the target area and increasing heat dissipation during operation. The tube may also be filled with a coolant fluid, such as oil, which is circulated to further dissipate heat. Each of these improvements are generally aimed at protecting the anode from excessive heat exposure.

Similarly, attempts have been made to minimize filament failure. Conventional X-ray tubes typically contain two filaments of different sizes which may not be used interchangeably. Therefore, when either filament fails, the tube has to be replaced. X-ray tubes having multiple identical filaments are also available. In such tubes, after a failure of the first filament, operation of the X-ray system need only be delayed long enough to switch operation to a new filament. The problem with these X-ray tubes having multiple identical filaments is that they provide only a redundant alternative to immediate break-down of the X-ray system. Thus, after a first failed filament, an operator still has little warning for subsequent filament failures. At this point, energizations can continue, but with each additional energization the risk of unexpected system failure increases. In essence, after a first failed filament, the tube has the same vulnerability to failure as if it contained only a single filament.

Alternatively, an operator can replace a dual filament X-ray tube with dual identifcal filaments entirely in order to circumvent the risk of critical failure. In this scenario, the operational filament, after only a few energizations, is wasted. Therefore, although such a dual filament X-ray tube provides a good back-up in the event of a initial filament failure, it does not provide a reliable way to predict the ultimate failure of the X-ray tube as a result of the second or last filament failure. In addition, such a mode of operation does not improve the life of a filament beyond that of normal operation.

SUMMARY OF THE INVENTION

The present invention is directed to a method and an apparatus for extending the life of an X-ray tube having at least two filaments of like size.

In accordance with this invention, it is a object of the invention to provide an improved method for operating an X-ray tube which maximizes filament life, comprising alternating energization among like filaments to maintain even wear of the filaments.

It is a further object of the invention to provide a method of predicting filament failure based on the detected failure of a preceding filament, thereby allowing convenient scheduling of X-ray tube replacement and avoiding X-ray tube failure during critical use.

It is another object of the present invention to provide a versatile X-ray system having an X-ray tube with multiple like-sized filaments which produce substantially similar focal sizes, means for successively energizing the filaments and means for predicting filament failure.

An X-ray system according to the present invention comprises an X-ray tube having at least two filaments of like size, means for independently energizing the individual filaments, means for detecting the failure of an individual filament and means of signaling imminent failure of still-functioning filaments. The signaling mechanism will provide visual or audible warnings of such imminent failure.

The filaments are successively energized to produce successive X-ray exposures. Such successive energization of each filament ensures even wear among all of the filaments. Thus, in an X-ray tube with two filaments, the life span of the X-ray tube is effectively doubled.

In another embodiment of the invention, energizations of a given filament are repeated over a pre-determined period of time, such a 24 hour day, after which time the next filament is used for a series of exposures over a like pre-determined period. Thus, in a medical application, the first filament could be energized for each exposure taken during the first 24 hour period and the second filament could be energized for each exposure taken during the next 24 hours. At the end of the second day during which the last filament in the X-ray tube had been energized for each exposure request, the first filament would again be energized for exposures taken during a succeeding day.

In yet another embodiment, each filament is energized a predetermined number of times before successively energizing the next filament. For example, in a medical X-ray application, the first filament would be successively energized for say the first ten exposures, and the second filament energized for the next ten exposures. This would continue until the tenth exposure is taken using the last filament at which point, the first filament would again be energized for each of the next ten successive exposures.

Another aspect of the invention includes a method for predicting filament failure for X-ray tubes having multiple filaments of like size. By successively energizing the filaments according to the above mentioned method and monitoring the electrical integrity or X-ray output of the filaments, the failure of still functioning filaments can be predicted. Because of even wear of the filaments, the failure of one filament is a direct indication of imminent failure of still-functioning filaments. Upon prediction of an imminent filament failure, a visible or audio signal is activated to warn the operator. In this way, the system gives notice prior to failure of the X-ray tube. Thus, maintenance can be scheduled at a convenient time, thereby avoiding unexpected tube failures during normal use and especially during critical medical procedures.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawings in which:

DESCRIPTION OF A PREFERRED EMBODIMENT

Figure 3:
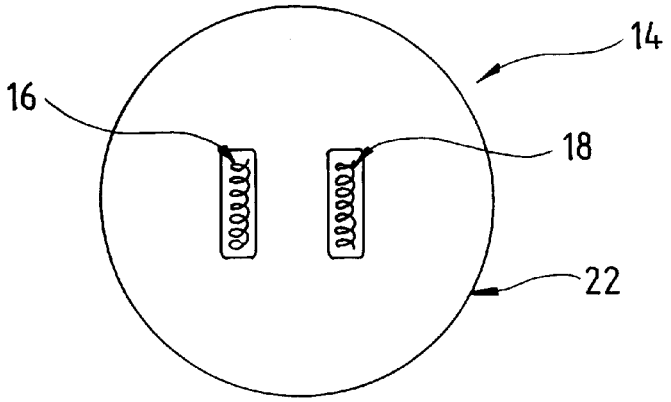
FIG. 3 is a schematic representation of an X-ray tube cathode having dual filaments of substantially the same size.

A cathode assembly of an X-ray tube 14 having two filaments 16 and 18 set within a focusing cup 22 which may be used in the practice of the present invention is shown in FIG. 3. Filaments 16 and 18 are of like size so that when similarly energized, each filament produces a focal spot of substantially the same size and energy. Thus, the filaments 16 and 18 are functionally equivalent, such that operation of the tube 14 will remain unaffected upon switching from one filament to the next.

The size of the filaments 16 and 18 is chosen to produce the optimum focal size for the desired application. In the present embodiment, filaments 16 and 18 are of a size appropriate for use in digital radiographic systems and fluoroscopic applications. As these applications require relatively low doses of radiation, the small filaments provide sufficient exposures while minimizing the dose delivered to the patient.

Larger size filaments may also be used. For example, conventional film-based applications require a significantly larger dose of radiation to achieve the desired image. For such use, larger filaments would be necessary.

Although the invention contemplates use of X-ray tubes having various sizes of filaments, the invention requires that the filaments 16 and 18 within a particular X-ray tube 14 be of nearly identical size. This maximizes the system's capability to ensure even wear of the filaments 16 and 18 and to accurately predict future filament failure.

In the case of the embodiment of FIG. 3, the first filament 16 is of like size and therefore functionally equivalent to the second filament 18. Thus, both filaments 16 and 18 will wear out at approximately the same rate. Upon this basis, the failure of the first filament 16 will be a direct indication of the imminent failure of the second 18, provided both filaments 16 and 18 are operated in a similar manner. The reverse is also true if the second filament 18 fails before the first filament 16.

Figure 1:
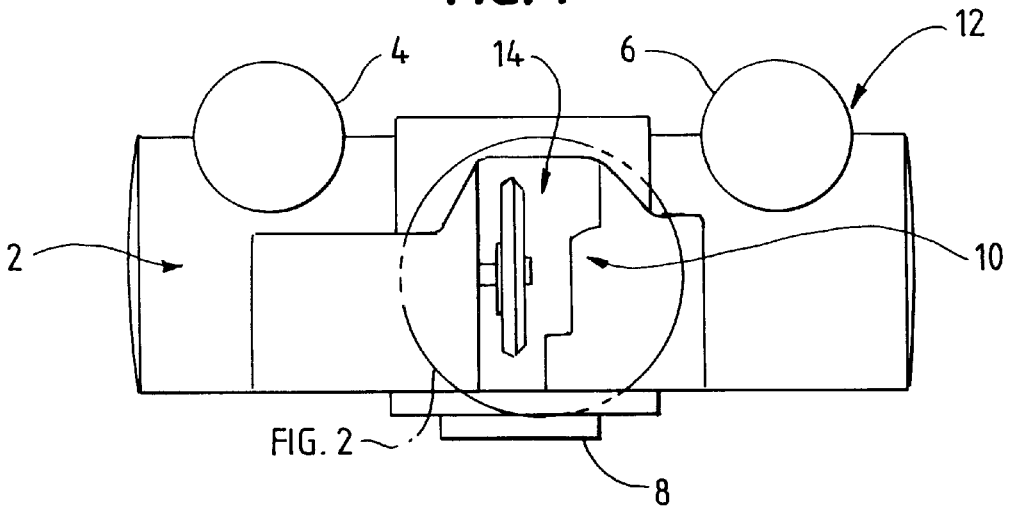
FIG. 1 is an X-ray tube assembly typical for X-ray applications.
Figure 2:
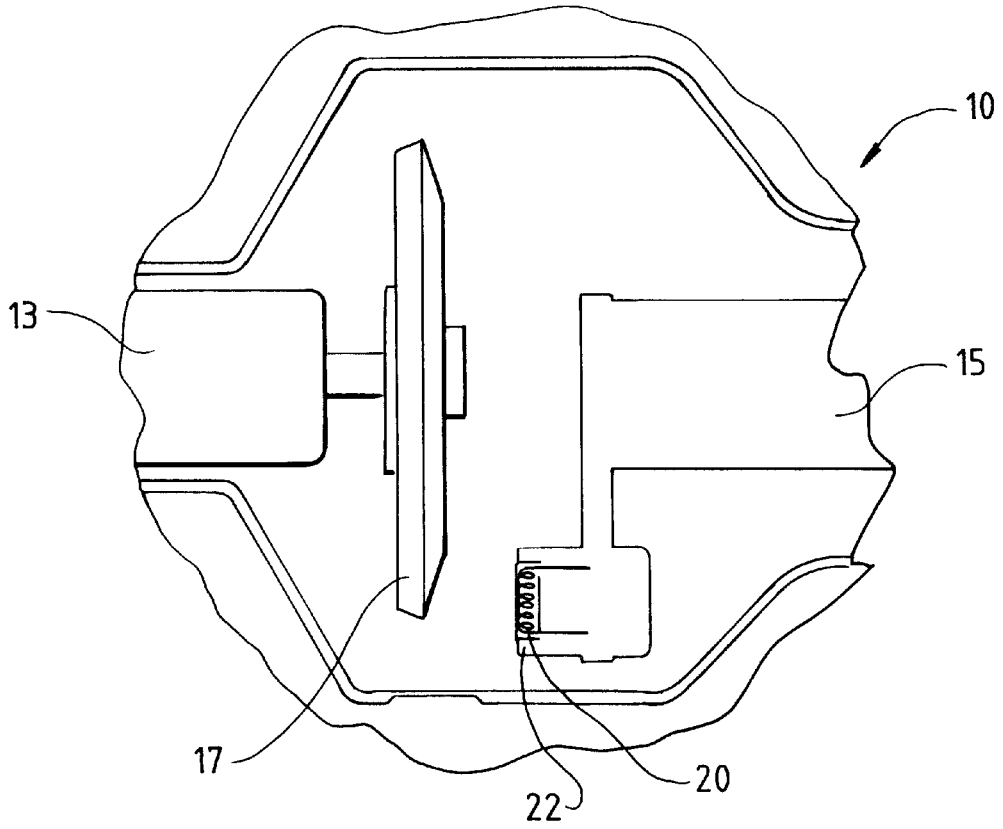
FIG. 2 is an enlarged sectional view of the internal components of a typical X-ray tube

The preferred embodiment is designed to interface with typical X-ray tube assemblies 12 comprising, an X-ray housing 2, two high voltage cable sockets 4 and 6, a tube window, or port, 8 and an X-ray tube 10, as shown in FIG. 1. FIG. 2 illustrates a common X-ray tube 10 configuration including an anode assembly 13 having a rotating anode 17 situated across from a cathode assembly 15 having filaments 20 housed in a focusing cup 22. In a preferred embodiment, the cathode assembly 15 includes two filaments 16 and 18 (FIG. 3), although in other embodiments the number of filaments 20 may be greater than this.

Figure 4:
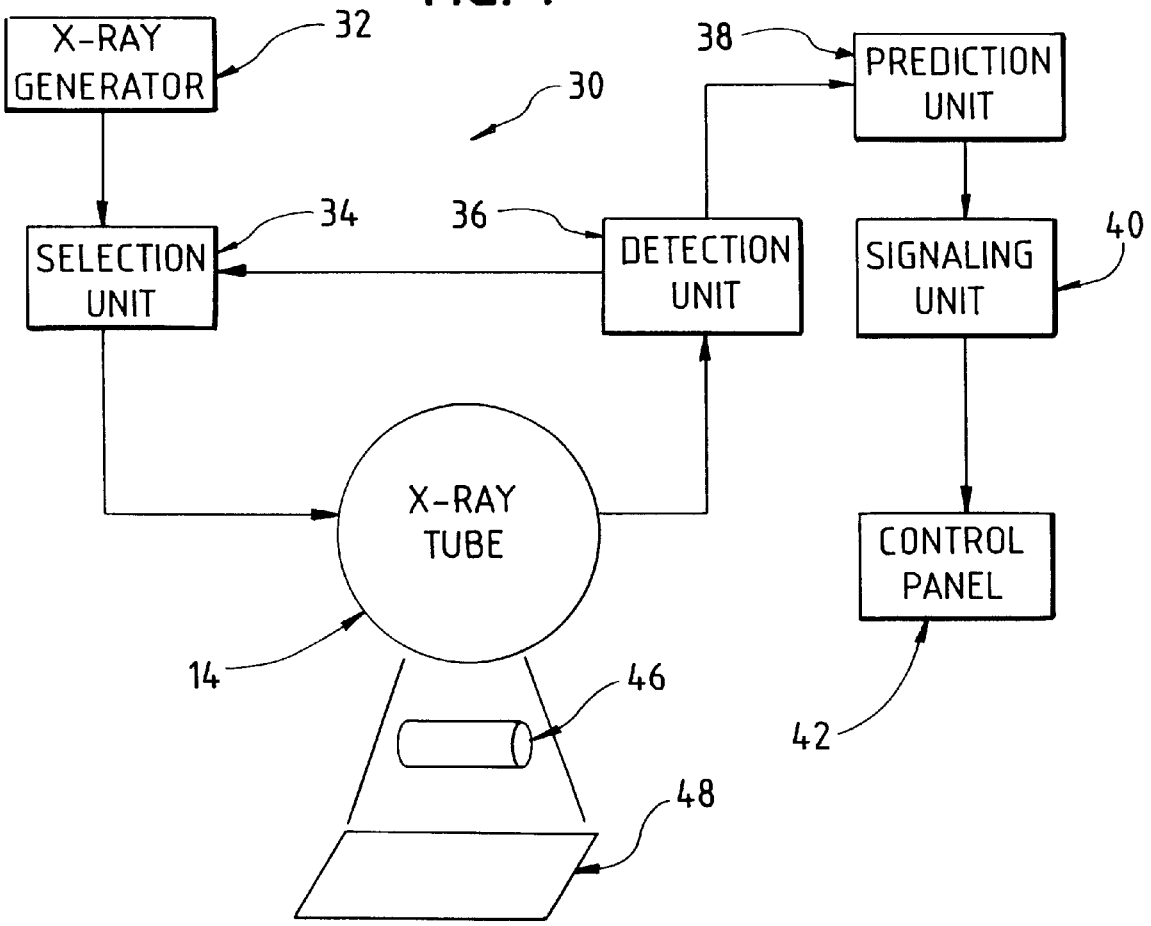
FIG. 4 is a block diagram showing the components of an X-ray system in accordance with the present invention.

We turn now to FIG. 4 in which the components of an X-ray system 30 are illustrated. Thus, an X-ray tube represented diagrammically by circle 14 is prepared in accordance with conventional techniques to pass X-rays through an object 46 onto an appropriate imaging medium 48, such as radiographic film or an image intensifier. The X-ray tube 14 has a cathode which consists of dual filaments each of like size as illustrated in FIG. 3.

A selection unit 34 is provided which interfaces with an X-ray generator 32 and which is switchably connected to each of the filaments in the cathode of the X-ray tube 14. The selection unit 34 functions to alternate the application of power individually to each of the filaments 16 and 18 (FIG.

3) to produce an X-ray exposure directed onto imaging medium 48 located beneath object 46. In a preferred embodiment, selection unit 34 comprises a switch. The switch may exist in various forms but must allow selection of only a single filament at a given time. At a basic level, a double pole, multiple throw switch can be utilized with the number of throws equal to the number of filaments and connected such that only one filament is selected at a time.

A detection circuit 36 is provided to monitor the electrical integrity of each filament to detect filament failure. The detection circuit 36 is connected at its input to the X-ray tube 14 and has at least one output connected to a prediction unit 38. In a basic embodiment, the detection circuit 36 is coupled to a particular filament via the selection unit 34 such that the filament selected by the selection unit 34 will also be connected to the detection circuit 36. In this way, current or resistance voltage across the active filament may be sensed in order to determine the electrical integrity of each filament to detect filament failure.

In the event of an open circuit, the detection circuit 36 will be triggered to indicate filament failure. The prediction unit 38 is then signaled by the detection unit 36 that a filament has failed. In addition, the selection unit 34 may then be directed to switch energization to the next successive filament in the cathode. Therefore, after a filament has failed, the system automatically and transparent to the patient, alternates energization to the next functional filament.

In the most basic embodiment, once the prediction unit 38 receives a filament failure signal, a signal unit 40, connected to the prediction unit 38, is then activated to warn the X-ray system operator of imminent filament failure with either a visual or an audible signal. However, the prediction unit 38 can also be designed to function in a more complex fashion. This is useful, particularly in X-ray tubes having more than two filaments in order to avoid premature failure warnings. For instance, in a tube having three filaments which is energized successively every 10 exposures, a first filament failure would predict the failure of the second filament within the next 10 exposures. Therefore, final tube failure would not occur until approximately 20 exposures later. Therefore, the prediction capability can be optimized by taking into account the number of filaments and the number of exposures or the duration of the filament switching cycle. Alternatively, prediction of imminent filament failure may be achieved by monitoring accumulated load on a particular filament in terms of the accumulated products of the voltage, amperage and time of each X-ray exposure (kV * mA * t). This value, which is typically measured in terms of kiloheat units (KHU), is compared to a pre-determined value indicative of the expected filament life and when the accumulated KHU for a filament reaches the threshold value, imminent filament failure is predicted. Expected filament life in terms of KHU may be taken from manufacturer's specifications or determined experimentally.

Signal unit 40 is configured to warn the operator that filament failure and ultimately X-ray tube 14 failure is imminent. Such a signal may take the form of an indicator lamp capable of visual recognition located on a control panel 42. Alternatively, an audio signal projected from a speaker or a buzzer, located on the control panel 40 or elsewhere, or an error code or message display also on the control panel or elsewhere may be used. For X-ray tubes having more than two filaments it is useful to distinguish between signaling of filament failure and signaling of final tube failure. Therefore, the signal unit 40 may consist of more than one distinguishing warning signal, code or message.

Figure 5:
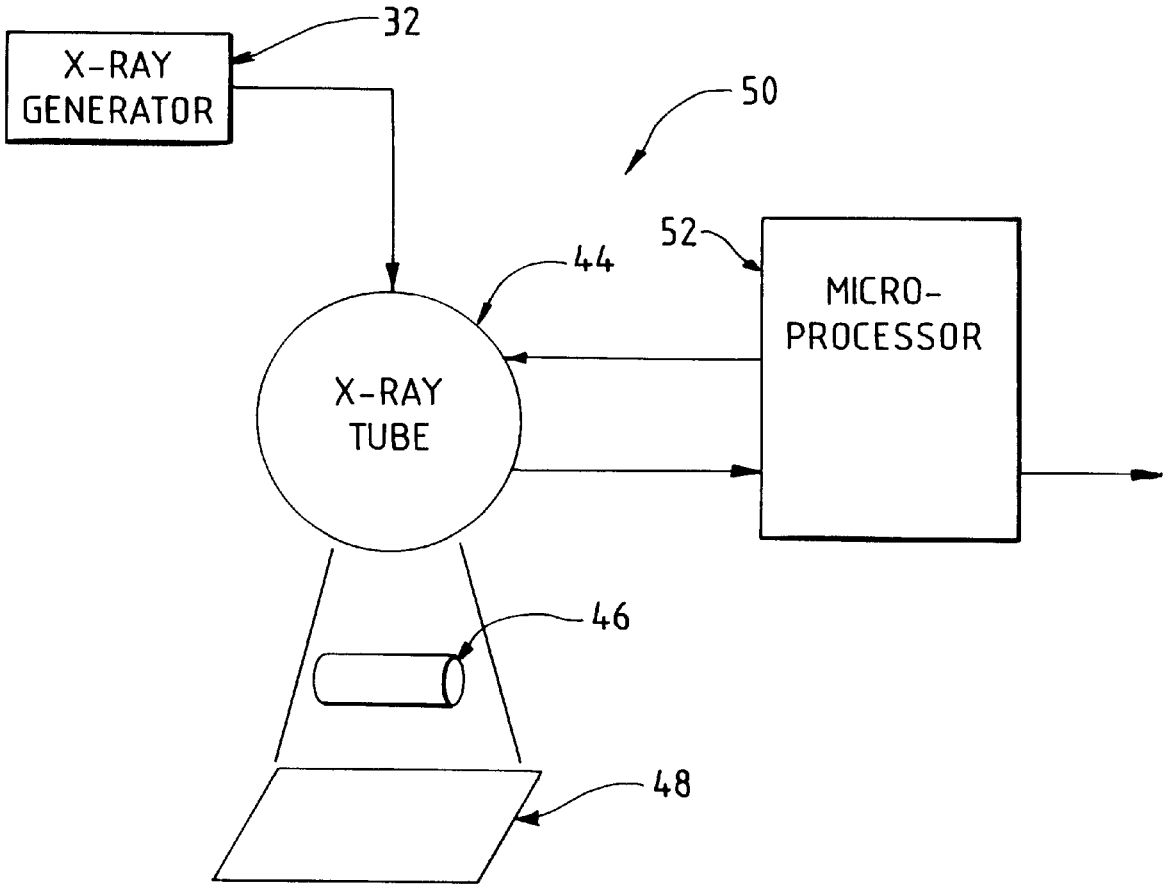
FIG. 5 is a block diagram showing a preferred embodiment of the X-ray system of FIG. 4 including a microprocessor.

A alternative embodiment of an X-ray system, generally designated 50, including a microprocessor 52 is shown in FIG. 5. The microprocessor 52 generally performs the functions of the selection unit 34, the detection circuit 36, the prediction unit 38 and the signal unit 40 of the previous embodiment. For example, the selection unit 34 may consist of a microprocessor controlled multiplexer. The number of outputs for the multiplexer would equal to the number of filaments. Thus, a three filament X-ray tube requires a multiplexer having three outputs and two control inputs. In this way, switching energization from one filament to the next is accomplished by activating the proper control input combination, via the microprocessor, in order to activate the mutiplexer output which is connected to the desired filament.

The microprocessor 52 is further capable of timing and counting functions as well as other programmable tasks. In this manner, the microprocessor is able to control the switching function on a continuous and automatic basis.

For example, programmed with a particular switching cycle, the microprocessor 52 is able to alternate selection of a filament for energization to the next successive filament when the switching cycle is complete. The microprocessor 52 restarts the cycle for the presently selected filament. In a looping fashion, this sequence continues to repeat itself until the program tells the microprocessor 52 to exit the sequence. Since the microprocessor 52 has both timing and counting capability, the switching cycle can be set for most any duration or for most any number of energizations.

For example, using a X-ray tube 14 having two filaments 16 and 18, a switching cycle may be programmed to occur every 24 hours measured either from the start of the working day (say 7:00 a.m.) or from the initial energization of a particular filament. Thus, upon an initial energization of the first filament 16, the timer of the microprocessor 52 will start timing. The first filament 16 will remain selected during this first period. Therefore, all exposures taken during this period will originate from the first filament 16.

After 24 hours, the timer will reset itself and the microprocessor 52 will select the second filament 18. Optionally, the timer starts again upon a first exposure request after the second filament 18 is selected. It is important to note that energizations requested prior to and extending beyond a cycle transition will postpone a subsequent switch to the next filament until the exposure is complete. This has particular importance for fluoroscopic applications, where exposures have longer duration. This problem will be eliminated in the alternative embodiment where the 24 hour period is measured from the start of the working day since fluoroscopic (and, of course, radiographic) exposures of a particular patient would not extend from one work day to the next. In this alternative embodiment, a real time clock is used to maintain timing of the 24 hour period even while the X-ray apparatus is turned off.

The microprocessor 52 also easily functions as the detection circuit and the prediction unit. Using a simple logic comparator algorithm, the microprocessor 52 can be coupled to the X-ray tube 14 to detect filament failure by sensing the electrical integrity of a selected filament by measuring voltage, current or resistance across the filament. Once a filament has failed, the microprocessor 52 can initiate a prediction algorithm which determines the appropriate action to be taken, such as activating a preliminary warning signal or activating a system failure warning signal.

Such a prediction algorithm is also easily capable of weighing such factors as the number of filaments present, the number of failed filaments, the number of exposures, the duration of the filament switching cycle, as well as the accumulated KHU of the filaments. Thus, the failure of a first filament in an X-ray tube having more than two filaments may not warrant an immediate tube failure warning but only a preliminary first failed filament warning. This setup is useful where an X-ray tube has one faulty filament which fails significantly sooner than the remaining functioning filaments.

Figure 6:
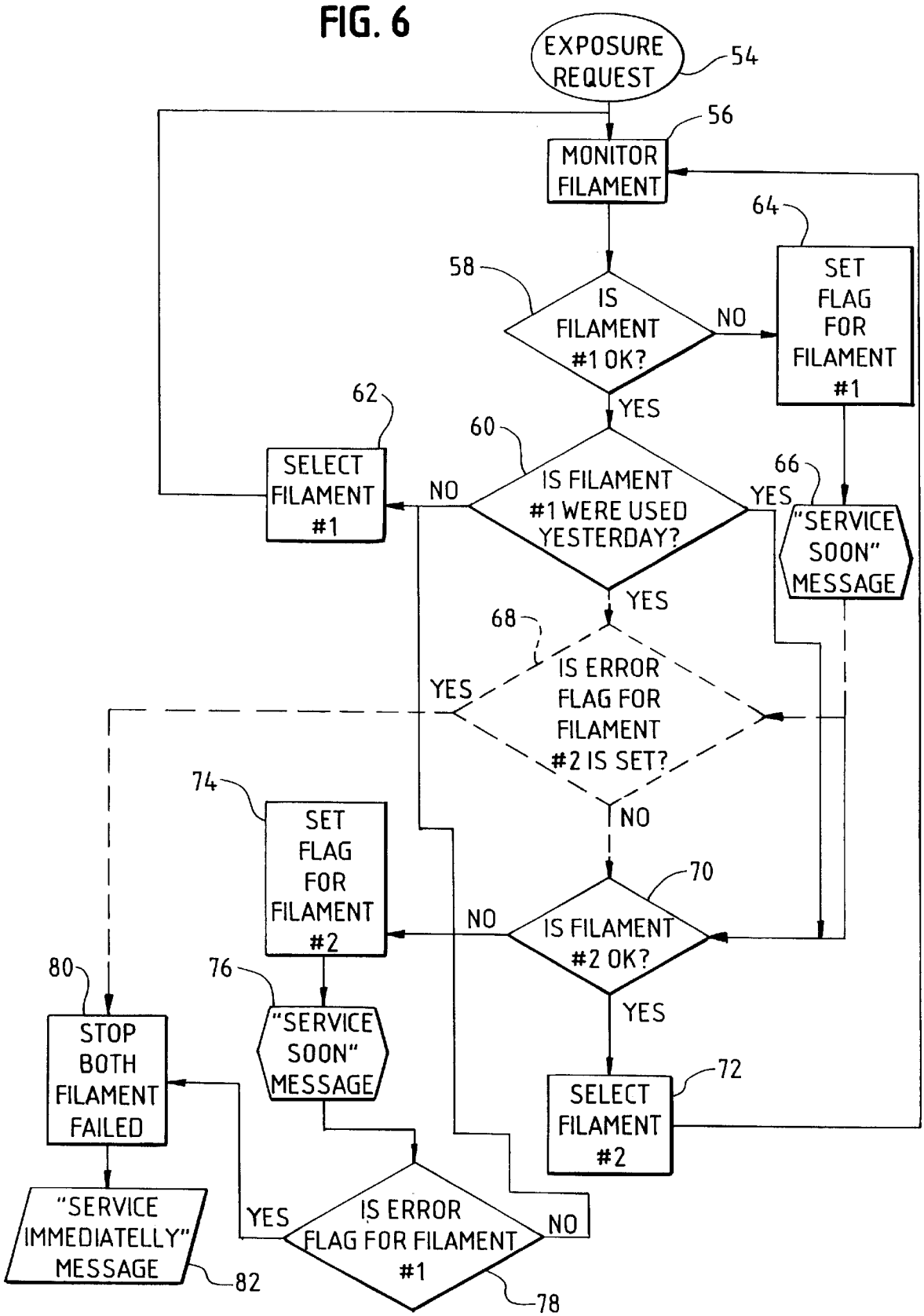
FIG. 6 is a flow chart illustrating an exemplary method of operating a dual filament cathode X-ray tube in accordance with the present invention.

FIG. 6 sets forth an exemplary method for operating a dual filament X-ray tube 14. The method is preferably carried out using the microprocessor 52 shown in FIG. 5. Generally, the method is used to control a selection unit 34 for alternating energization between two filaments 16 and 18.

Initially, an exposure request 54 is received from the operator of the X-ray system. The filaments are monitored 56 first for functionality 58 and second to determine whether the filament was used during the preceding filament switching cycle 60. If the filament has failed, an error flag 64 is set for the first filament 16 and in the preferred embodiment, a "Service Soon" message 66, located on the operator control panel 42, is activated to alert the operator of the failure. Thereafter, the second filament 18 is monitored 70 for similar status checks. Thus, transparent to the patient, the system alternates from the failed filament 16 to the second filament 18, while at the same time, provides notice of the failure such that replacement of the X-ray tube 14 can be scheduled at a convenient time.

If the first filament 16 is functional, the microprocessor 52 determines whether the filament 16 has been energized during the prior switching cycle 60. As previously mentioned, the switching cycle represents a predetermined period during which all energizations of the cathode are applied to the same filament. Therefore, the microprocessor 52 times the duration of which the first filament 16 has been selected and compares that duration to a preprogrammed value which represents the desired switching cycle duration for alternating energization to the successive filament. It is only after such period lapses that energization is alternated to a different filament.

In a preferred embodiment, filament energization is set to alternate on a daily basis. Therefore, if the first filament 16 was used yesterday 60, i.e. the first filament 16 has been selected for more than 24 hours, the system alternates 70 to the second filament 18. If the first filament 16 was not used yesterday, i.e. it has been selected for less than 24 hours, the first filament 16 is selected for energization 62 and the sequence loops back to the steps of monitoring 56, 58 and 60 the first filament 16.

The first filament 16 will remain the selected filament until either the first filament 16 fails 64, 66 or until the end of the day 60. In either event, the microprocessor 52 alternates 70 to the second filament 18. It is understood that the energization period can be set for any period of duration. In this case, the system would alternate energization to the second filament 18 after the specified time period had lapsed.

In addition, it may be desirable to have energization alternate to a successive filament after a predetermined number of exposures. For example, energization of the filaments may be alternated after every use or after every tenth use. Thus, energization would alternate from the first filament 16 to the second filament 18 after the predetermined number of energizations had been reached.

The preferred embodiment is based on a dual filament cathode. Therefore, the second filament 18 becomes the next filament in the energization sequence. For most modes, the succeeding filament undergoes generally the same status checks as the preceding filament.

In this embodiment, the second filament 18 is monitored for functionality 70. If the second filament 18 is still functional, it is selected for energization 72 and loops to the beginning monitoring step 56. The system will only exit this loop when the second filament 18 fails 70 or when the energization period has lapsed and the first filament 16 is no longer the prior filament used 60.

If the second filament 18 has failed 70, an error flag is set for the second filament 74. Like a first filament failure, a "Service soon" message 76 is then activated to alert the operator of the failure. The system then alternates to the first filament 16. In the event the first filament 16 is also not functional 58, the system is stopped 80 and a "Service immediately" message is activated 82.

At this point the X-ray tube 14 is not functional and must be replaced. However, as long as the first filament 16 remains operational 58, the system will continue to select 62 the first filament 16 as the filament to be energized. During this period, the operator, made aware of the second filament 18 failure from the warning message, can schedule replacement of the X-ray tube 14 at a non-critical time.

In an alternate embodiment, step 68 may be performed to provide a safety mechanism against prolonged energization where the cathode has only one remaining operational filament. Step 68 checks the status of the error flag for the second filament 18. If the flag is set, meaning the filament 18 is not functional, the system is stopped 80 and the "Service immediately" message 82 is activated. The X-ray tube 14 then must be replaced.

Unlike the prior embodiment, step 68 prevents the operator from continued energization when only one filament is operational. Therefore, unlike the prior embodiment, which allows continued cycling until failure of the remaining filament, this embodiment allows for only one final cycle after the second filament 18 has failed. This is useful in critical situations where the possibility of an unexpected failure is too risky to warrant continued use where only one filament is operational.

Although a dual cathode filament is described herein, it is contemplated to use cathodes having more than two filaments. In such systems, monitoring of all the filaments is necessary. In the event of a filament failure, the system would continue alternating energization of the remaining filaments until the next to last filament, or at least a majority of the filaments, has failed. It may be desirable to activate warning signals for each failed filament or only after a predetermined number of failures.

Having illustrated and described preferred embodiments of the present invention and various modifications thereof, it will be apparent that the invention permits further modifications in arrangement and detail. Accordingly, it is not intended that the invention be limited except as may be necessary in view of the appended claims.

What is claimed is:

1. A method for extending the life of an X-ray tube having multiple filaments of like size, the method comprising successively energizing each filament to produce successive X-ray exposures.

2. The method of claim 1, further comprising monitoring the electrical integrity of each filament as it is energized to determine whether the monitored filament is functional or non-functional.

3. The method of claim 2 further comprising activating a warning signal if the monitored filament is determined to be non-functional.

4. The method of claim 1, wherein each filament is energized a predetermined number of times before successively energizing a next filament.

5. The method of claim 1, wherein successive filaments are energized only after a predetermined period of time has elapsed.

6. The method of claim 5, wherein the predetermined period of time is measured from the start of the working day.

7. The method of claim 5, wherein the predetermined period of time is measured from the initial energization of the preceding filament.

8. The method of claim 5, wherein the predetermined period of time is 24 hours.

9. The method of claim 1 wherein the X-ray tube is replaced after energizing each of the filaments a predetermined number of times corresponding to a predicted useful life of the filaments.

10. A method for predicting filament failure in an X-ray tube having at least two filaments of like size, the method comprising:

successively energizing each filament to produce successive X-ray exposures;

monitoring the electrical integrity of each of the filaments as it is energized to determine whether the monitored filament is non-functional; and producing an indication of imminent failure of one or more functioning filaments when a non-functional filament is detected.

11. The method of claim 10 wherein the indication of imminent failure is a visible signal.

12. The method of claim 10 wherein the indication of imminent failure is a audible signal.

13. The method of claim 10, wherein each filament is energized a predetermined number of times before successively energizing a next filament.

14. The method of claim 10, wherein a particular filament is energized only after a predetermined period of time has elapsed.

15. The method of claim 13, wherein the predetermined period of time is 24 hours.

16. A controller for controlling an X-ray system including an X-ray tube having a cathode with at least two filaments of like size, a generator for energizing the X-ray tube and an imaging medium, comprising:

means for successively energizing each filament to produce successive X-ray exposures;

means for monitoring each filament as it is energized to determine whether the monitored filament is non-functional; and means for predicting imminent failure of a still functional filament when a non-functional filament is detected.

17. The X-ray controller of claim 16, further including a signaling means for indicating the imminent failure of a still functional filament.

18. The X-ray controller of claim 17, wherein the signaling means comprises a visible signal.

19. The X-ray controller of claim 17, wherein the signaling means comprises an audible signal.

20. The X-ray controller of claim 16, wherein the means for successively energizing comprises a switch for successively energizing the filaments.

21. The X-ray controller of claim 16, wherein monitoring means comprises a means for measuring the electrical integrity of each filament.

22. The X-ray controller of claim 16, wherein monitoring means comprises a microprocessor capable of sensing the electrical integrity of each filament.

23. The X-ray controller of claim 16, wherein the means for successively energizing, the means for monitoring and the means for predicting comprise a microprocessor.

24. The X-ray controller of claim 16, wherein the means for predicting compares the accumulated kiloheat units applied to the filament with a predetermined value indicative of the expected filament life.

25. The X-ray controller of claim 24, wherein the means for predicting comprises a microprocessor.

* * * * *

UNITED STATES PATENT AND TRADEMARK OFFICE

CERTIFICATE OF CORRECTION

| | |
|---|---|
| PATENT NO. : | 5,901,197 |
| DATED : | May 4, 1999 |
| INVENTOR(S) : | Khutoryansky et al |

It is certified that error appears in the above-identified patent and that said Letters Patent is hereby corrected as shown below:

Column 9, line 39, delete "13" and insert --14--

Signed and Sealed this

Twelfth Day of October, 1999

*Attest:*

Q. TODD DICKINSON

*Attesting Officer*

*Acting Commissioner of Patents and Trademarks*